US009410497B2

(12) United States Patent
Igarashi et al.

(10) Patent No.: US 9,410,497 B2
(45) Date of Patent: Aug. 9, 2016

(54) ELECTRICAL CONTROL UNIT

(71) Applicant: DENSO CORPORATION, Kariya, Aichi-pref. (JP)

(72) Inventors: Hiroki Igarashi, Hekinan (JP); Toru Itabashi, Anjo (JP); Takahiko Furuta, Nagoya (JP)

(73) Assignee: DENSO CORPORATION, Kariya (JP)

( * ) Notice: Subject to any disclaimer, the term of this patent is extended or adjusted under 35 U.S.C. 154(b) by 301 days.

(21) Appl. No.: 14/264,145

(22) Filed: Apr. 29, 2014

(65) Prior Publication Data

US 2014/0336902 A1 Nov. 13, 2014

(30) Foreign Application Priority Data

May 8, 2013 (JP) ..... 2013-098730

(51) Int. Cl.
*F02D 41/30* (2006.01)
*F02D 41/20* (2006.01)
*F02M 59/10* (2006.01)

(52) U.S. Cl.
CPC ..... *F02D 41/3005* (2013.01); *F02D 41/20* (2013.01); *F02D 2041/2003* (2013.01); *F02D 2041/2006* (2013.01);
(Continued)

(58) Field of Classification Search
CPC ..... F02D 41/3005; F02D 41/20; F02D 2041/2003; F02D 2041/2006; F02D 2041/2027; F02D 2041/2048; F02D 2041/2051; F02D 2041/2093; F02M 59/102
USPC ..... 701/103; 123/494, 479, 490
See application file for complete search history.

(56) References Cited

U.S. PATENT DOCUMENTS 5,161,510 A * 11/1992 Yamada ..... F02D 41/20 123/478
6,988,489 B2 * 1/2006 Tanaka ..... F02D 41/0027 123/479

(Continued)

FOREIGN PATENT DOCUMENTS

JP 07-269404 A 10/1995
JP H08-126304 A 5/1996

(Continued)

OTHER PUBLICATIONS

Office Action mailed May 19, 2015 issued in corresponding JP patent application No. 2013-098730 (and English translation).

*Primary Examiner* — Stephen K Cronin
*Assistant Examiner* — Susan E Scharpf
(74) *Attorney, Agent, or Firm* — Posz Law Group, PLC

(57) ABSTRACT

An electrical control unit includes a constant voltage supply unit which supplies a constant voltage to a fuel injector, a boosted voltage supply unit which supplies a boosted voltage to the fuel injector, a control unit which controls supply timings of the constant voltage supply unit and the boosted voltage supply unit, and an interrupter which interrupts electric current when a short-circuit occurs in the boosted voltage supply unit. When an interruption of the interrupter is not detected, the boosted voltage supply unit supplies boosted voltage to start a fuel injection and the constant voltage supply unit supplies constant voltage to continue the fuel injection. When an interruption of the interrupter is detected, the constant voltage supply unit and the boosted voltage supply unit advance an interrupted power supply start timing relative to a non-interrupted power supply start timing to prevent delay of a fuel injection start timing.

5 Claims, 6 Drawing Sheets

(52) U.S. Cl.
CPC ..... *F02D 2041/2027* (2013.01); *F02D 2041/2048* (2013.01); *F02D 2041/2051* (2013.01); *F02D 2041/2089* (2013.01); *F02D 2041/2093* (2013.01); *F02M 59/102* (2013.01)

(56) References Cited

U.S. PATENT DOCUMENTS 7,621,259 B2 * 11/2009 Mayuzumi ..... F02D 41/20 123/490
8,214,132 B2 * 7/2012 Bunni ..... F02D 41/20 123/472
8,773,833 B2 * 7/2014 Itabashi ..... H05K 1/0293 361/104
8,780,518 B2 * 7/2014 Furuta ..... H05K 1/0293 361/104
8,783,230 B2 * 7/2014 Okonogi ..... F02D 41/20 123/478
8,971,003 B2 * 3/2015 Furuta ..... H01H 85/0241 361/103
8,971,006 B2 * 3/2015 Mikami ..... H01H 85/10 361/104
9,148,948 B2 * 9/2015 Shiraishi ..... H05K 1/0265
9,166,397 B2 * 10/2015 Mikami ..... H05K 1/0265
2004/0244778 A1 * 12/2004 Tanaka ..... F02D 41/0027 123/479
2008/0184968 A1 8/2008 Matsuura
2009/0107469 A1 * 4/2009 Takahashi ..... F02D 41/20 123/490
2012/0200970 A1 8/2012 Itabashi
2013/0104856 A1 * 5/2013 Fukuda ..... F02D 41/20 123/490
2014/0253282 A1 * 9/2014 Itabashi ..... H05K 1/0293 337/416
2015/0109746 A1 * 4/2015 Furuta ..... H01H 85/0241 361/752

FOREIGN PATENT DOCUMENTS

JP 2003-143838 A 5/2003
JP 2007-311467 A 11/2007

* cited by examiner

ELECTRICAL CONTROL UNIT

CROSS REFERENCE TO RELATED APPLICATION

The present application is based on and claims the benefit of priority of Japanese Patent Application No. 2013-098730, filed on May 8, 2013, the disclosure of which is incorporated herein by reference.

TECHNICAL FIELD

The present disclosure generally relates to an electrical control unit (ECU) for controlling an operation of a fuel injection device.

BACKGROUND

A Japanese patent document 1 (i.e., Japanese Patent Laid-Open No. 2011-247185) discloses a fuel injection control device for controlling each of the injectors installed in the cylinders of an internal-combustion engine. The fuel injection control device has a capacitor which supplies a high voltage to an electromagnetic valve and a booster circuit which boosts the battery voltage and charges a capacitor. Further, the fuel injection control device has a discharge switch that is installed in an electric current path which electrically connects the capacitor and the electromagnetic valve. The discharge switch is implemented as a MOSFET. The booster circuit has a first electric current path which connects the battery and the capacitor, and a second electric current path which branches from the first electric current path to lead to a ground. The first electric current path has a booster coil, and the second electric current path has a booster switching element. By switching the booster switching element ON and OFF, the battery voltage is boosted by the booster coil, and the boosted voltage is applied to the capacitor, and the capacitor is charged by the boosted voltage. The boosted voltage or a high voltage charged in the capacitor is applied to the electromagnetic valve of the injector by the turning ON of the discharge switch. Thereby, the electromagnetic valve opens and injection of the fuel is started. After the fuel injection is started, the battery voltage is applied to the electromagnetic valve at a predetermined apply timing (i.e., not from the capacitor but from the other path), for maintaining an open state of the electromagnetic valve and for continuing the fuel injection. Then, after the stoppage of the application of the battery voltage, the electromagnetic valve is closed and the fuel injection is stopped.

In the fuel injection control device disclosed in the patent document 1, in case that a circuit element provided in the electric current path that connects the ground and a boosted voltage path, which is a path for applying the boosted battery voltage to the electromagnetic valve, is short-circuited, an output voltage from the boosted voltage path to the electromagnetic valve becomes substantially the same as a ground voltage. The circuit element in the above case may be, for example, the capacitor of the fuel injection control device or the switching element in the patent document 1. As a result, even when an ON signal is input to the gate of MOSFET which is a discharge switch for the valve opening, MOSFET will not be turned ON and the voltage from the boosted voltage path will not be applied to the electromagnetic valve. In such case, at the predetermined apply timing, the battery voltage is applied from the other path and the electromagnetic valve starts to open at such timing. Therefore, in comparison to a non-short-circuited case, the start of the valve opening is delayed, thereby delaying the start of the fuel injection, which may result in that a preset amount of fuel cannot be injected within a predetermined period.

SUMMARY

It is an object of the present disclosure to provide an electrical control unit which prevents a delay of a fuel injection start timing, which may be observed in an above-mentioned situation.

In an aspect of the present disclosure, an electrical control unit for controlling an operation of a fuel injector includes a constant voltage supply unit supplying a preset voltage to the fuel injector, a boosted voltage supply unit supplying, to the fuel injector, a boosted voltage that is higher than the preset voltage, and a control unit controlling a supply timing of the constant voltage supply unit and a supply timing of the boosted voltage supply unit. The boosted voltage supply unit includes a booster circuit having an input of a power supply voltage, generating the boosted voltage by boosting the power supply voltage, and outputting the boosted voltage, and a discharge unit electrically connecting the booster circuit and the fuel injector when turned ON, and electrically interrupting the booster circuit and the fuel injector when turned OFF. The booster circuit includes a coil disposed in a first current path to which the power supply voltage is input on one end of the coil and from which the boosted voltage is output, a switching element (i) disposed in a second current path that leads from an other end of the coil to a reference voltage that is lower than the power supply voltage and (ii) supplying electric current to the coil when turned ON, a capacitor (i) disposed in a third current path that leads from a junction of the first current path and the second current path and leads to the reference voltage and (ii) charged by a counter electromotive force that is generated in the coil due to the turning ON and OFF of the switching element, and an interrupter (i) disposed in at least one of the second current path or the third current path, (ii) connected in series with the switching element or the capacitor, and (iii) interrupting electric current flowing through the interrupter when the switching element or the capacitor is short-circuited. The control unit includes a detector detecting whether the interrupter is interrupted, and at a fuel injection start time of the fuel injector, the control unit controls the discharge unit and the constant voltage supply unit to (i) supply the boosted voltage to start the fuel injection, (ii) supply the preset voltage to continue the fuel injection when the detector detects that the interrupter is not interrupted, and (iii) advance an interrupted power supply start timing relative to a non-interrupted power supply start timing when the detector detects that the interrupter is interrupted.

Thus, according to the present disclosure, when the switching element or the capacitor which is connected in series to the interrupter becomes short-circuited, the interrupter interrupts the electric current flowing in the second or the third current path in which the short-circuited switching element or capacitor is disposed. That is, the first current path is not short-circuited to the reference voltage. Therefore, the booster circuit is enabled to output a voltage that is higher than a voltage at a "first-current-path short-circuited" time (i.e., when the first current path is short-circuited to the reference voltage).

Here, when the switching element or the capacitor is short-circuited, the booster circuit will lose a booster function which raises the battery voltage, and the output voltage of the booster circuit becomes lower than the boosted voltage. Therefore, when the interrupter is interrupted, an applied voltage that is applied to the fuel injector becomes lower than the boosted voltage that is applied thereto when not short-circuited, and a time from a voltage application to the start of the fuel injection becomes longer. Therefore, in the conventional configuration, the fuel injection start timing is delayed.

In contrast, in the present disclosure, the detector detects whether the interrupter is interrupted. When an interruption of the interrupter is detected, the control unit controls the discharge unit and the constant voltage supply unit advances an Interrupted power supply start timing (i.e., to an earlier timing) relative a non-interrupted power supply start timing (i.e., a power supply start timing when short-circuiting has not occurred).

In the above, reference numbers are used to show an example correspondence between the description and the configuration in the embodiment that is mentioned later, for the ease of understanding of the present disclosure. However, what is meant by such reference numbers is not restricting/limiting the range of the present disclosure at all. Further, the features of the present disclosure other than the ones mentioned above will become apparent from the explanation and accompanying drawings of the embodiment described below.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
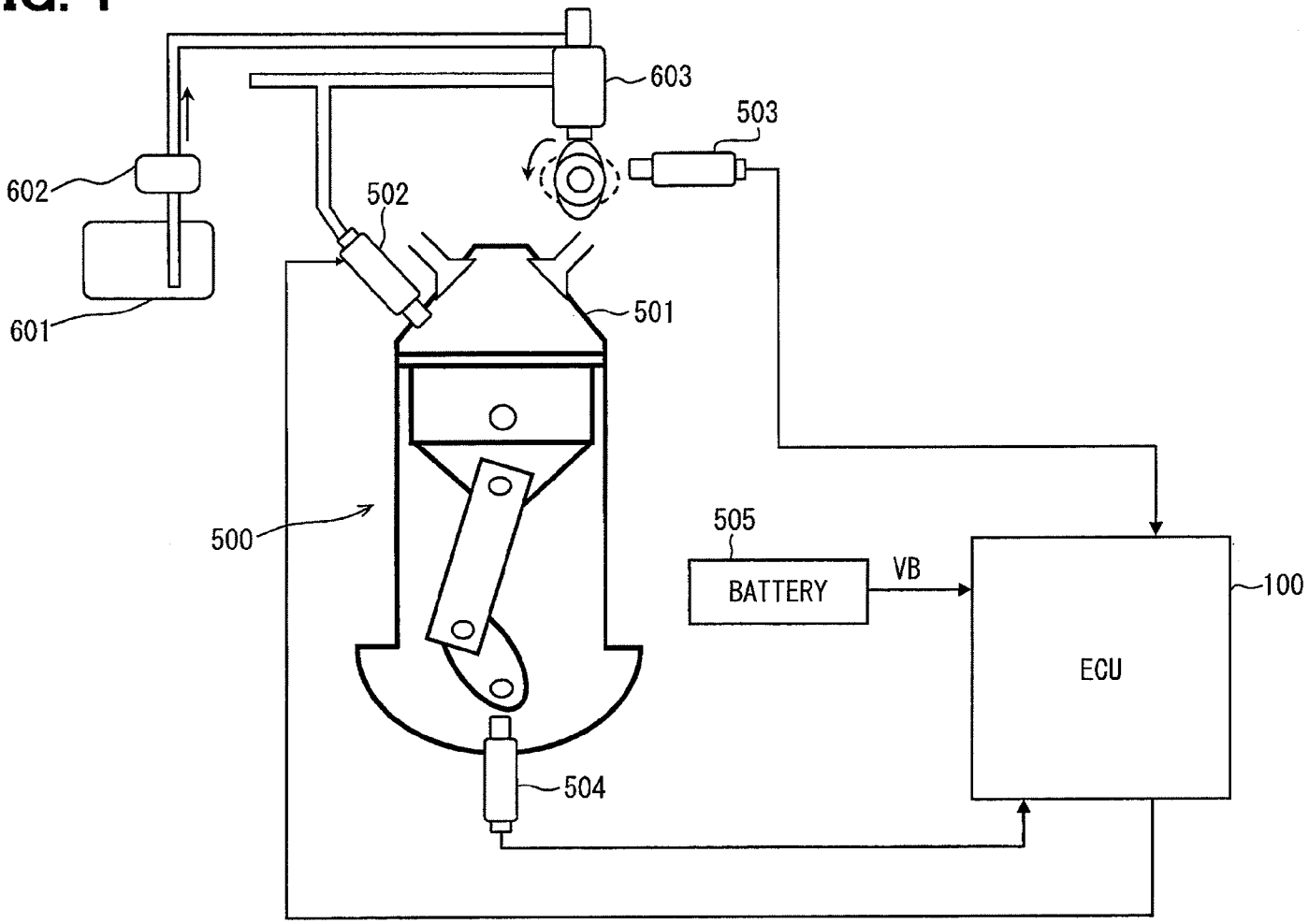
FIG. 1 is an illustration of a configuration of an electrical control unit (ECU) in a first embodiment of the present disclosure and an internal-combustion engine to which the ECU is applied.

Hereafter, an embodiment of the invention is described based on the drawing.

First Embodiment

First, the whole picture of an electrical control unit (ECU) 100 concerning the present embodiment and the internal-combustion engine 500 to which the ECU 100 is applied is explained. As shown in FIG. 1, the ECU 100 is a device which controls the fuel injection of an injector 502 which injects fuel directly into a combustion chamber 501 of each of the plural cylinders of the internal-combustion engine 500. The injector 502 is equivalent to a fuel injector in the claims.

The fuel stored in a fuel tank 601 is supplied to the injector 502 via a low pressure fuel pump 602 and a high pressure fuel pump 603. The fuel stored in the fuel tank 601 is specifically supplied to a high pressure fuel pump 603 in a low pressure by the low pressure fuel pump 602, and the high pressure fuel pump 603 receiving the low pressure fuel raises the low fuel pressure to a high fuel pressure, for supplying it to the injector 502. The injector 502 injects the supplied fuel directly into the combustion chamber 501 according to the voltage applied from the ECU 100.

The outputs of a cam angle sensor 503 and a crank angle sensor 504 provided in the internal-combustion engine 500 are input into the ECU 100, and, based on such outputs, the ECU 100 detects a fuel injection timing, and applies a voltage to the injector 502. Then, by such application of a certain voltage, the fuel is injected from the injector 502. To the ECU 100, a battery voltage VB is supplied from a battery 505.

In FIG. 1, although only one cylinder is shown, the injector 502 is provided for every cylinder, and the ECU 100 applies a voltage to each of four cylinders, in case that the internal-combustion engine 500 is a 4-cylinder engine, for example.

Although the ECU 100 is described as controlling the injector 502 in one of plural cylinders in the following description, the same applies to the controlling of the injector 502 in each of two or more cylinders respectively.

Figure 2:
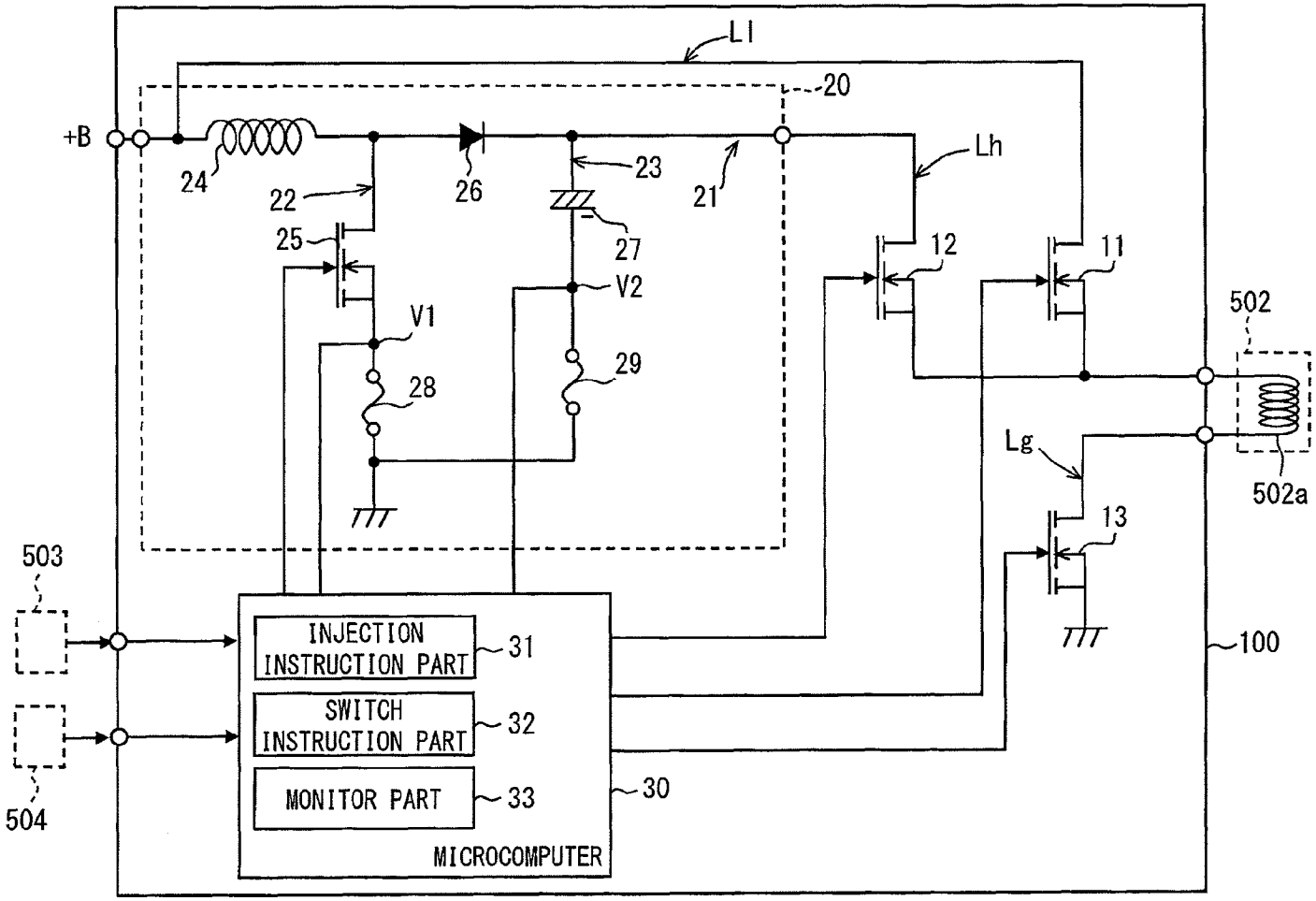
FIG. 2 is a block diagram of the ECU in FIG. 1.

Based on FIG. 2, the ECU 100 which controls the injector 502 concerning the present embodiment are described.

The injector 502 has an electromagnetic valve and a magnet coil 502*a* which opens and closes the electromagnetic valve. A voltage is applied to the magnet coil 502*a* of the injector 502 from the ECU 100. By supplying an electric power to the magnet coil 502*a*, a valve body, which is not illustrated, moves to a valve opening position, and a fuel injection is performed. Then, when a power supply to the magnet coil 502*a* is interrupted, the valve body returns to an original valve closing position, and the fuel injection is stopped.

The ECU 100 has a +B terminal to which a battery voltage VB is applied, and has a constant current path Ll which electrically connects the +B terminal and an upstream side terminal of the injector 502. A constant current switch 11 is disposed in the constant current path Ll (Ll: L+l).

The ECU 100 has a booster path Lh which is another path for electrically connecting the +B terminal and the upstream side terminal of the injector 502. The booster circuit 20 which generates a boosted voltage applied to the injector 502 is disposed in the booster path Lh, and a discharge switch 12 is disposed at a position between the booster circuit 20 and the injector 502.

The ECU 100 has a downstream path Lg which electrically connects a downstream side terminal of the injector 502 and a ground, and a downstream switch 13 is disposed in the downstream path Lg.

Thus, the ECU 100 has the constant current switch 11, the discharge switch 12, the downstream switch 13, and the booster circuit 20.

The ECU 100 has a microcomputer 30 which performs a booster control of the booster circuit 20, and a turning ON and OFF control of the constant current switch 11, the discharge switch 12, and the downstream switch 13.

The constant current switch 11, when it is turned ON, electrically connects the +B terminal and the upstream side terminal of the injector 502, and, when it is turned OFF, electrically interrupts a connection between them. The discharge switch 12, when it is turned ON, electrically connects an output terminal of the booster circuit 20 and the upstream side terminal of the injector 502, and, when it is turned OFF, electrically interrupts a connection between them. The downstream switch 13, when it is turned ON, electrically connects the downstream side terminal of the injector 502 and the ground, and, when it is turned OFF, electrically interrupts a connection between them.

Therefore, when the constant current switch 11 and the downstream switch 13 are turned ON, the battery voltage VB is applied to the injector 502, and electric current flows accordingly. When the discharge switch 12 and the downstream switch 13 are turned ON, the output voltage of the booster circuit 10 is applied to the injector 502, and electric current flows accordingly. As the constant current switch 11, the discharge switch 12, and the downstream switch 13, MOSFET may be used, for example.

The booster circuit 20 has a first current path 21 to which the battery voltage is input and which outputs the boosted voltage that is a boosted voltage of the battery voltage VB and a second current path 22 and a third current path 23 that respectively branch from the first current path 21 to lead to the ground.

A coil 24 to which the battery voltage VB is applied on one end is disposed in the first current path 21, and the other end of the coil 24 is electrically connected to the second current path 22. In the second current path 22, a charge switch 25 is disposed, which flows electric current through the coil 24 when it is turned ON. The turning ON and OFF control of the charge switch 25 is performed by an instruction of the microcomputer 30. By the turning ON and OFF of the charge switch 25, a counter electromotive force is generated in the coil 24. MOSFET may be used as the charge switch 25, for example.

In the first current path 21, a diode 26 for preventing a reverse flow is disposed at a junction point of the first current path 21 and the second current path 22, to which an anode of the diode 26 is connected. A cathode of the diode 26 is electrically connected to the third current path 23. In the third current path 23, a capacitor 27 is disposed, which is charged by the counter electromotive force generated in the coil 24. In the ECU 100, although a ceramic multilayer capacitor is used as the capacitor 27, other type of capacitors, such as an electrolytic capacitor or the like, may also be used.

Further, as a feature of the present disclosure, in the second current path 22, a first interrupter wiring 28 is disposed in series to the charge switch 25 at a position between the charge switch 25 and the ground. Further, in the third current path 23, a second interrupter wiring 29 is disposed in series to the capacitor 27 at a position between the capacitor 27 and the ground. Each of the interrupter wirings 28 and 29 generates heat according to the electric current flowing therein, and, when a predetermined fusing temperature is exceeded, respectively, the wirings 28 and 29 are fused, for interrupting the electric current flowing therein.

The fusing temperature of each of the interrupter wirings 28 and 29 is set to have a value so that the interrupter wirings 28 and 29 are fused before the temperature of the coil 24 exceeds a preset temperature by a self-generated heat that is caused by the electric current following therein.

The microcomputer 30 is electrically connected to and controls the switching of (i.e., for the turning ON and OFF) each of the constant current switch 11, the discharge switch 12, the downstream switch 13, and charge switch 25, and sends instructions to them for the switching of them. The microcomputer 30 has an injection instruction part 31 which generates an injection signal according to a combustion cycle of the internal-combustion engine 500 and a switch instruction part 32 which instructs the turning ON and OFF of the constant current switch 11, the discharge switch 12, the downstream switch 13, and the charge switch 25 according to the injection signal.

The injection instruction part 31 generates the injection signal which instructs a start and a stop of fuel injection based on the output of the cam angle sensor 503 and the crank angle sensor 504 which are input to the microcomputer 30. The injection signal is input to the switch instruction part 32, and the switch instruction part 32 outputs the control signal for switching between the turning ON and OFF to the constant current switch 11, the discharge switch 12, the downstream switch 13, and the charge switch 25 based on the injection signal.

Further, the microcomputer 30 is electrically connected at a position between the charge switch 25 and the first interrupter wiring 28 in the second current path 22, and has a monitor part 33 which monitors a first monitor potential V1 which is a potential junction point to the second current path 22. The microcomputer 30 also is electrically connected to a position between the capacitor 27 and the second interrupter wiring 29 in the third current path 23, and the monitor part 33 also monitors a second monitor potential V2 which is a potential of a junction point to the third current path 23.

Next, an operation of the ECU 100 concerning the present embodiment is explained.

First, how a boosted voltage is generated by the booster circuit 20 is explained. When the charge switch 25 is turned ON according to an instruction of the microcomputer 30, the battery voltage VB is applied to the coil 24, and electric current flows into the coil 24. Then, according to an instruction of the microcomputer 30, when the charge switch 25 is turned OFF, a counter electromotive force occurs in the coil 24, and the capacitor 27 is charged. The turning ON and OFF of the charge switch 25 is repeatedly performed until the charge voltage of the capacitor 27 reaches a predetermined boosted voltage, and, as a result, the boosted voltage is generated.

Next, a detection of the short-circuit of the charge switch 25 and the capacitor 27 in the booster circuit 20 is explained. When the charge switch 25 and the capacitor 27 have not short-circuited, the first monitor potential V1 and the second monitor potential V2 is equated to the ground potential. On the other hand, when the charge switch 25 is short-circuited, a surge current flows into the second current path 22, the first interrupter wiring 28 generates heat and is fused, and the first monitor potential V1 is equated to the battery voltage VB. Therefore, when the potential of the first monitor potential V1 currently monitored is equated to the ground potential, the monitor part 33 of the microcomputer 30 determines that a short-circuit has not occurred in the charge switch 25, and, when the potential of the first monitor potential V1 is equated to a potential that is higher than the ground potential, it determines that a short-circuit has occurred in the charge switch 25.

The same determination is made when the capacitor 27 is short-circuited. That is, in such a case, a surge current flows into the third current path 23, and the second interrupter wiring 29 generates heat and is fused, and the second monitor potential V2 is equated to the battery voltage VB. Therefore, the monitor part 33 of the microcomputer 30 determines that a short-circuit has not occurred in the capacitor 27 when the potential of the second monitor potential V2 currently monitored is equated to the ground potential, and, when the potential of the second monitor potential V2 is equated to a potential that is higher than the ground potential, it determines that a short-circuit has occurred in the capacitor 27.

Figure 3:
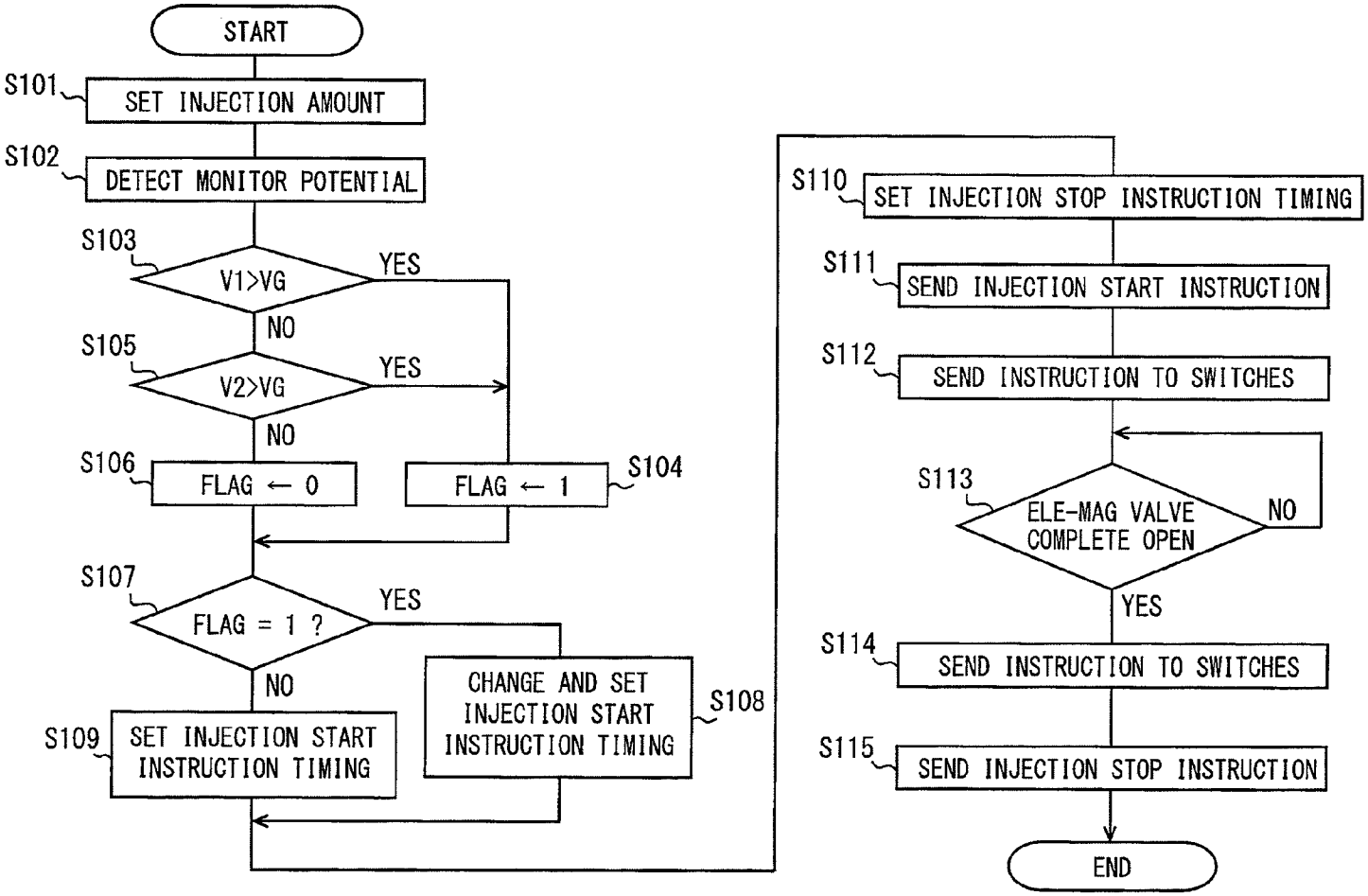
FIG. 3 is a flowchart of a process performed by the ECU in FIG. 1.
Figure 4:
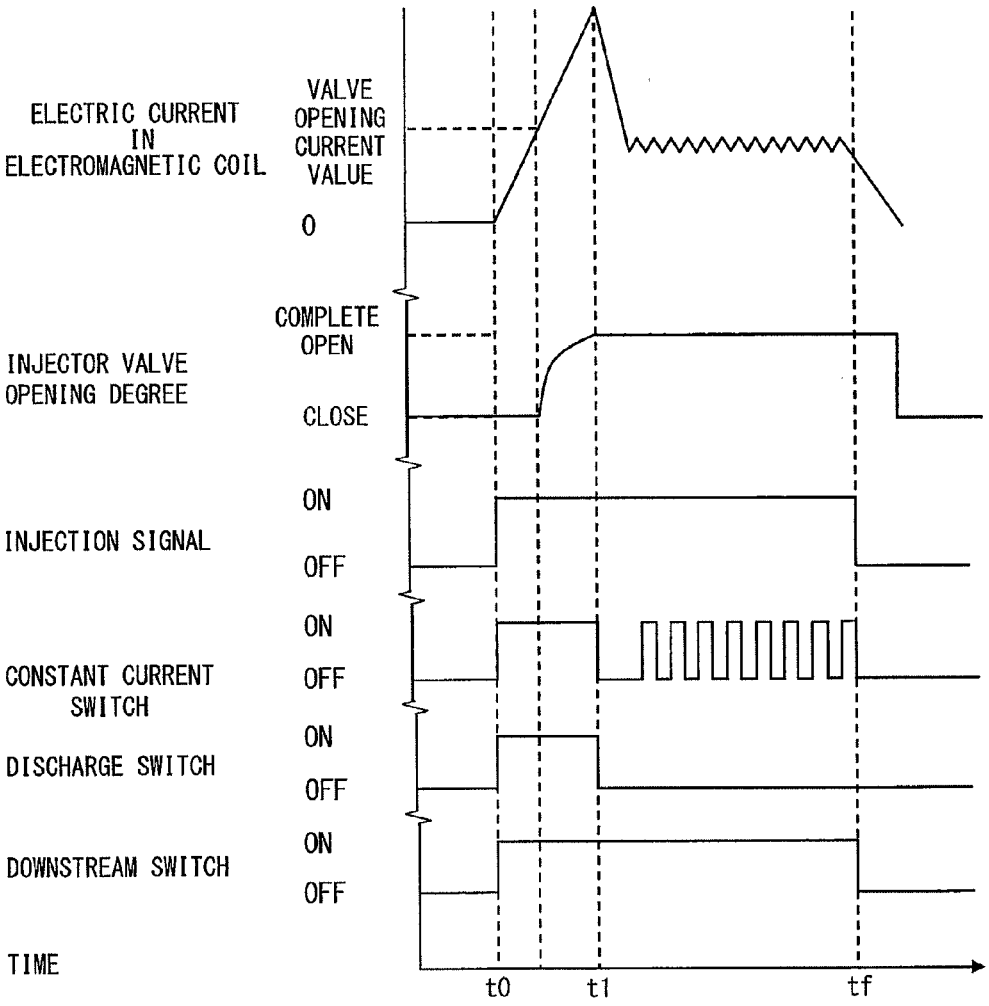
FIG. 4 is a time chart of an operation of each of the components at a normal operation time of the ECU in FIG. 1.
Figure 5:
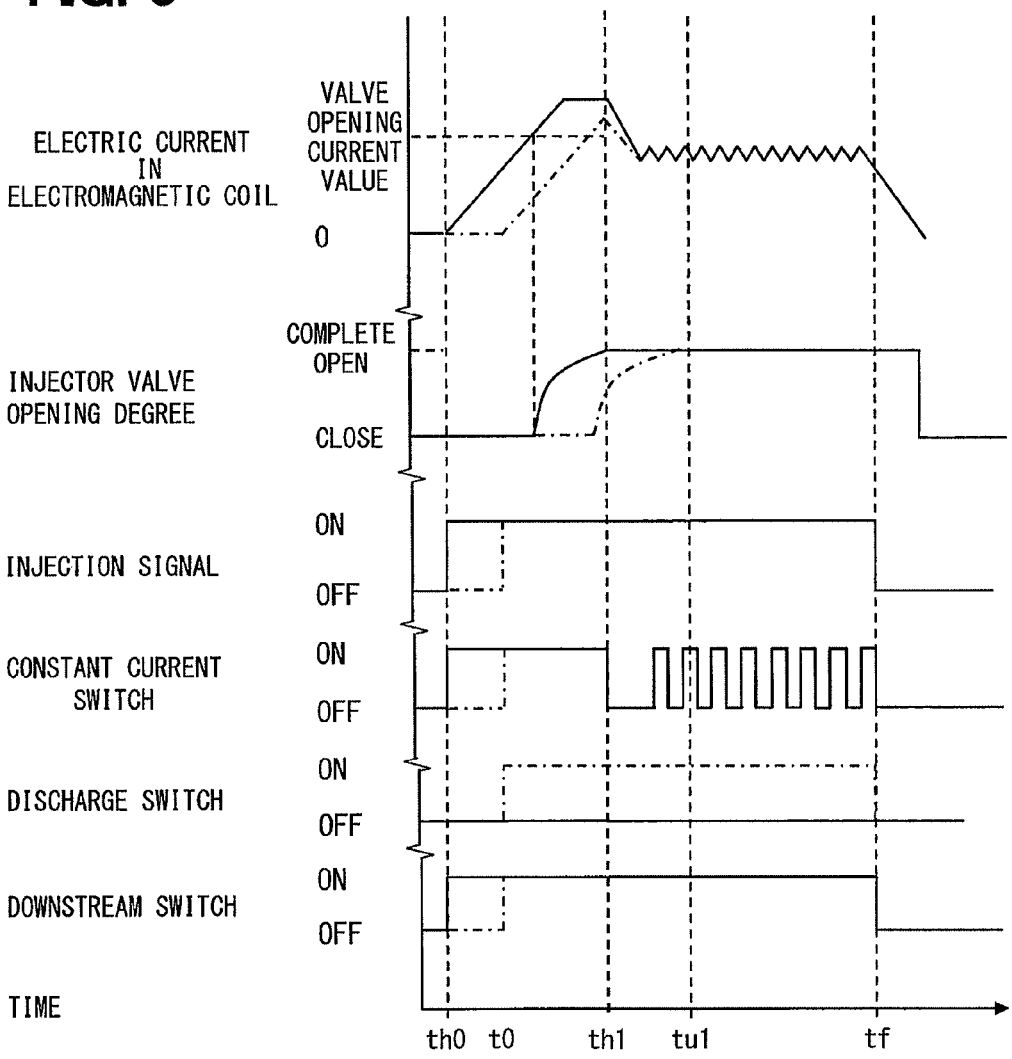
FIG. 5 is a time chart of an operation of each of the components at a short-circuit problem time of the ECU in FIG. 1.

Next, a control of the voltage applied to the injector 502 is explained. FIG. 3 is a flowchart with which a process performed by the microcomputer 30 for the control of the voltage that is applied to the injector 502 is shown. FIGS. 4 and 5 are time charts which show an example of the operation of each of the components at a time of performing the flowchart process. FIG. 4 is a time chart of a normal case, that is, when the charge switch 25 and the capacitor 27 have not short-circuited. FIG. 5 is a time chart of a short circuit case, that is, when the charge switch 25 and the capacitor 27 are short-circuited. With reference to these time charts, the flowchart in FIG. 3 is explained.

First, the microcomputer 30 sets up an injection amount of the fuel (S101). Next, the monitor part 33 of the microcomputer 30 detects the potentials, i.e., the first monitor potential V1 and the second monitor potential V2 (S102). Then, the monitor part 33 determines whether the detected first monitor potential V1 is higher than the potential VG, i.e., the ground potential (S103), and, when it determines that the detected potential is higher, the monitor part 33 sets a predetermined flag in the microcomputer 30 to "1" (S104). This flag shows that the charge switch 25 or the capacitor 27 is short-circuited, that is, when the flag is 1, the flag shows that a short-circuit has occurred, and, when the flag is 0, the flag shows that a short-circuiting has not occurred. Therefore, when a flag is set to 1 in S104, the flag shows that a short-circuit has occurred in the charge switch 25 or the capacitor 27.

On the other hand, when it is determined that the first monitor potential V1 is not higher than the ground potential VG in S103, the monitor part 33 determines whether the detected second monitor potential V2 is higher than the ground potential VG (S105). When it is determined that the second monitor potential V2 is higher than the ground potential VG, S104 mentioned above is performed and the monitor part 33 sets the flag to 1, which shows that a short-circuit has occurred. On the other hand, when it is determined that the second monitor potential V2 is not higher than the ground potential VG in S105, the monitor part 33 sets the flag to 0, which shows that a short-circuiting has not occurred (S106).

Next, the microcomputer 30 determines whether the value of the flag is set to 1 (S107), and, if the flag value is 1, the injection instruction part 31 sets an injection start instruction timing to an earlier timing th0, which is earlier than a normal timing for a non-short-circuited time, i.e., when the charge switch 25 or the capacitor 27 has no trouble (S108), and the process proceeds to S110. On the other hand, if the flag value is 0, the injection instruction part 31 sets the injection start instruction timing to a timing t0, which is the normal timing (S109), and the process proceeds to S110.

In S110, the injection instruction part 31 sets up an injection stop instruction timing tf according to the injection amount set up in S101 and the injection start instruction timing set up in S108 or S109.

Next, the injection instruction part 31 sends an injection start instruction to the switch instruction part 32 at the injection start instruction timing set up in S108 or S109 (S111). Specifically, an injection signal which is a signal sent from the injection instruction part 31 to the switch instruction part 32 to instruct an injection start and an injection stop is turned from an OFF state to an ON state. Thereby, when a short-circuit has not occurred, as shown in FIG. 4, an injection signal is turned from OFF to ON at a timing t0 that is set up in S109. On the other hand, when a short-circuit has occurred, an injection signal is turned from OFF to ON at a timing th0 that is set up in S108.

The switch instruction part 32 sends an ON instruction or an OFF instruction to the constant current switch 11, the discharge switch 12, and the downstream switch 13 (i.e., switching instruction to switches in FIG. 3), in response to the turning ON of the injection signal (S112). More specifically, when the flag value is 0, i.e., when not short-circuited has occurred, the switch instruction part 32 sends an ON instruction to the constant current switch 11, the discharge switch 12, and the downstream switch 13. In such manner, as shown in FIG. 4, the constant current switch 11, the discharge switch 12, and the downstream switch 13 are turned ON, and the battery voltage VB and boosted voltage are applied to the magnet coil 502*a* of the injector 502, and the electric current flowing in the magnet coil 502*a* steeply increases. When the electric current flowing in the magnet coil 502*a* exceeds a predetermined valve-opening electric current value, an electromagnetic valve moves toward a valve opening position. Then, after the electromagnetic valve opens completely, as described later, the battery voltage VB is applied to the magnet coil 502*a*, and the open state of the electromagnetic valve is maintained.

On the other hand, when the flag value is 1, i.e., when a short-circuit has occurred, the operation is as described in the following. That is, in FIG. 5, a solid line shows an operation of each of the components in the ECU 100 concerning the present embodiment, and a dashed-dotted line shows an operation of each of the components of the conventional ECU.

When the flag value is 1, i.e., when a short-circuit has occurred, in response to the turning ON of the injection signal, the switch instruction part 32 sends an ON instruction to the constant electric current switch 11 and the downstream switch 13. Thereby, as shown in FIG. 5, with the discharge switch 12 kept in an OFF state, the constant electric current switch 11 and the downstream switch 13 are turned ON, and the battery voltage VB is applied to the magnet coil 502*a* of the injector 502, and the electromagnetic valve moves the valve opening position.

In such a case, the voltage applied to the magnet coil 502*a* is the battery voltage VB that is lower than the boosted voltage. The increase speed of the electric current flowing in the magnet coil 502*a* at the time of a short-circuit is, as shown in FIGS. 4 and 5, slower than the increase speed at a not short-circuited time. As a result, when a short-circuit has occurred, a valve opening time which is a time from an application of the voltage to the electromagnetic valve to a complete opening of the valve is longer than the one at a non-short-circuited time.

Conventionally, as indicated by the dashed-dotted line in FIG. 5, since the application of the voltage to the magnet coil 502*a* starts at time t0 at the time of a short-circuit, a timing tu1 at which the electromagnetic valve opens completely is later than a timing t1 at a non-short-circuited time.

On the other hand, in the ECU 100 concerning the present embodiment, when a short-circuit has occurred, a voltage application start timing for starting an application of the voltage to the magnet coil 502*a* (i.e., an interrupted power supply start timing) is set (i.e., advanced) to the earlier timing th0 that is earlier than the timing t0 (i.e., non-interrupted power supply start timing), which is a normal timing of non-short-circuited time as mentioned above. Thereby, the timing th1, at which the electromagnetic valve opens completely, at the time of a short-circuit can be brought close to the timing t1 of non-short-circuited time, which is indicated by the solid line in FIG. 5.

Then, it is determined by the microcomputer 30 whether the electromagnetic valve has opened completely (S113). The determination is performed based on the electric current flowing in the magnet coil 502*a*. The determination in S113 is repeated until the electromagnetic valve opens completely, and, after the complete opening of the valve, the process proceeds to the next step S114.

In S114, since the electromagnetic valve has opened completely, the switch instruction part 32 sends an ON/OFF instruction to the constant electric current switch 11, the discharge switch 12, and the downstream switch 13 in order to maintain the open state of the electromagnetic valve. More specifically, when the flag value is 0, i.e., when short-circuiting has not occurred, first, the switch instruction part 32 sends an OFF instruction to the constant electric current switch 11 and the discharge switch 12 at the timing t1 at which the electromagnetic valve has opened completely. Then, in order to maintain the open state of the electromagnetic valve, the switch instruction part 32 repeatedly sends ON and OFF instructions to the constant electric current switch 11 so that a constant electric current flows in the magnet coil 502*a*.

On the other hand, when the flag value is 1, i.e., when a short-circuit has occurred, first, the switch instruction part 32 sends an OFF instruction to the constant electric current switch 11 at the timing th1 at which the electromagnetic valve has opened completely. Then, in order to maintain the open state of the electromagnetic valve, the switch instruction part 32 repeatedly sends ON and OFF instructions to the constant electric current switch 11 so that a constant electric current flows in the magnet coil 502*a*.

Next, the injection instruction part 31 turns the injection signal from the ON state to the OFF state at the timing if, i.e., at the injection stop instruction timing (S115). In response to such change of the signal from ON to OFF, the switch instruction part 32 sends an OFF instruction to the constant electric current switch 11 and the downstream switch 13. In such manner, the application of the voltage to the magnet coil 502*a* is stopped, and the electromagnetic valve closes, and the fuel injection stops. Thus, the process of the flowchart is finished. The above-described process from S101 to S115 is repeatedly performed at the time of an operation of the internal-combustion engine 500.

The above explanation is a control of the ECU 100 for the injector 502 that is disposed in one cylinder. However, a control of each of the injectors 502 that are respectively disposed in, for example, four cylinders may be performed by the ECU 100 in the same manner.

Figure 6:
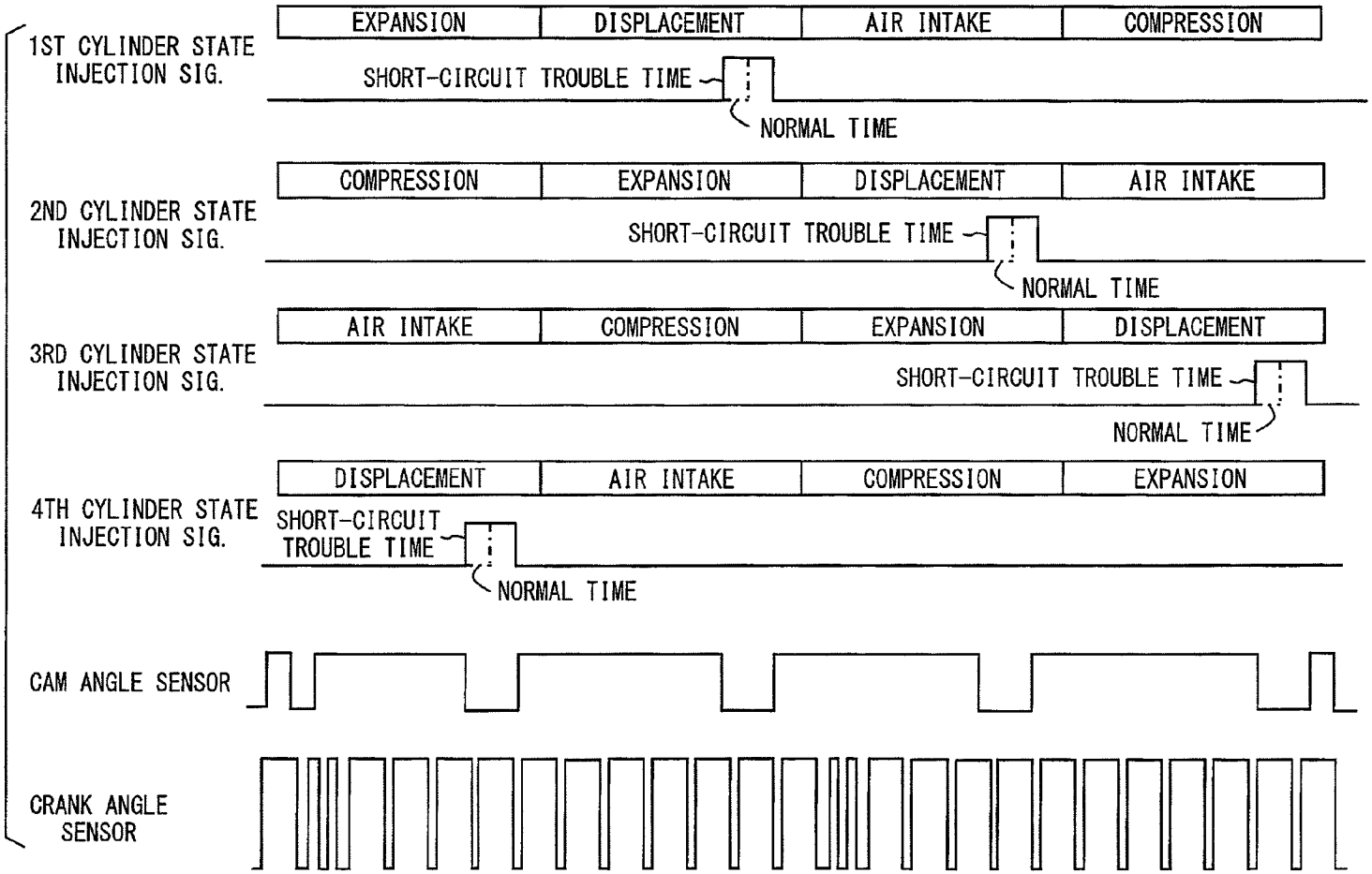
FIG. 6 is a time chart of an operation of each of the components when the ECU in FIG. 1 is applied to a four-cylinder internal-combustion engine.

In such a case, the ECU 100 performs a process in the flowchart of FIG. 3 to each of the injectors 502. Thereby, as shown in FIG. 6, the injection signal to instruct the injection start and the injection stop for each of the injectors 502 has an earlier injection start instruction timing when a short-circuit occurs (i.e., short-circuit trouble time), in comparison to a non-short-circuited time (i.e., in comparison to a normal time). In such manner, even when a short-circuit occurs and having a longer valve opening time, which is a time from the start of the application of the voltage to the magnet coil 502*a* to a complete opening of the electromagnetic valve, the earlier injection start instruction timing prevents a delay of the complete valve opening timing at which the electromagnetic valve opens completely.

Next, the effect of the ECU 100 concerning the present embodiment is explained. According to the ECU 100 in the present embodiment, when at least one of the charge switch 25 or the capacitor 27, which are respectively connected in series to the interrupter wiring 28 or 29, is short-circuited, the electric current flowing into the second electric current path 22 or the third electric current path 23 is interrupted by the interrupter wiring 28 or 29 that corresponds either to the charge switch 25 or the capacitor 27. That is, the first electric current path 21 does not short-circuit to ground. Therefore, the booster circuit 20 is enabled to output a voltage that is higher than the voltage at the time of the short-circuit of the first electric current path 21 short-circuiting to the ground. That is, the first electric current path 21 is enabled to output a voltage substantially equal to the battery voltage VB.

Further, according to the ECU 100 of the present embodiment, a short-circuit and a fusing of the interrupter wirings 28 and 29 are detected by the monitor part 33. Upon having such a detection, at the time of fuel injection, the battery voltage VB is applied to the injector 502 at an earlier timing earlier than the non-short-circuited time, under control of the microcomputer 30. Since the battery voltage VB is lower than the boosted voltage, the time required for a valve opening, which is a time from the voltage application start time to the coil 502*a* to the complete opening of the valve, is longer than a normal time, i.e., a non-short-circuited time, in the above situation. However, according to the ECU 100 of the present embodiment, when a short-circuit has occurred, the application of the voltage to the injector 502 starts at an earlier timing (i.e., is advanced) relative to the normal time. Thereby, even when a short-circuit has occurred, a timing of complete opening of the electromagnetic valve can be brought close to a timing of the normal time. Therefore, a delay of the fuel injection start timing due to a short-circuit is prevented.

Further, according to the ECU 100, when the charge switch 25 or the capacitor 27 is short-circuited, the voltage output by the booster circuit 20 is not applied to the magnet coil 502*a*. Therefore, at the time of having a short-circuit, the application of the output voltage of the booster circuit 20 to the magnet coil 502*a*, which leads to a flow of the electric current in the coil 24 and leads to heat generation in the coil 24, is prevented.

Further, according to the ECU 100, the interrupter wirings 28 and 29 are respectively arranged on a ground side of the charge switch 25 and the capacitor 27. Such positioning of the interrupter wirings 28 and 29 is examined in the following in terms of how the monitor part 33 monitors a monitor potential. That is, a monitoring point of the monitor part 33 may be one of following two points. The first monitoring point may be an upstream of the interrupter wirings 28 and 29, for monitoring an upstream potential.

First, the upstream potential of the interrupter wiring 28 that is disposed in the upstream of the charge switch 25 is the battery voltage VB at both of an interruption time of the interrupter wiring 28 and a normal time. Therefore, it cannot be determined whether it is a normal time or an interruption time based on the upstream potential of the interrupter wiring 28.

Next, the upstream potential of the interrupter wiring 29 disposed in the upstream of the capacitor 27 is the boosted voltage that is charged by the capacitor 27 at the normal time, and is the battery voltage VB at an interruption time of the interrupter wiring 29, since the booster circuit 20 loses its booster function at the interruption time. However, when the boosted voltage is not charged by the capacitor 27 such as a start-up time of the ECU 100, the upstream potential of the interrupter wiring 29 is not the boosted voltage even in the normal time. Therefore, the determination of the normal/interruption time based on the upstream potential of the interrupter wiring 29 may be correctly performed only when it is ascertained that it is not a start-up time of the ECU 100 or the like, which requires a complicated processing.

On the other hand, as the second monitoring point, a downstream potential of the interrupter wirings 28 and 29 may be monitored, which is a potential between the interrupter wiring 28 or 29, and the charge switch 25 or the capacitor 27. Since the downstream potential is higher than the ground at the normal time, or, is equated to the ground potential at the interruption time, because the charge switch 25 or the capacitor 27 is short-circuited. However, the charge switch 25 or the capacitor 27 may not be completely short-circuited at the interruption time, depending on the manner of short-circuiting. In such a case, the downstream potential does not fall to the ground potential. Therefore, in order to correctly determine whether it is the interruption time or the normal time based on the downstream potential, it is necessary to consider the manner how the short-circuit has occurred, which also complicates the determination processing.

However, according to the ECU 100 in the present embodiment, the interrupter wirings 28 and 29 are respectively arranged on the ground side of the charge switch 25 or the capacitor 27. Therefore, the monitor part 33 monitors the first monitor potential V1 and the second monitor potential V2, which are either a potential between the interrupter wiring 28 and the charge switch 25 or a potential between the interrupter wiring 29 and the capacitor 27. Both of the first monitor potential V1 and the second monitor potential V2 are equated to the ground potential at the normal time, and are equated to a higher-than-the-ground potential at the interruption time. The potential at the normal time and the potential at the interruption time do not change depending on the charge state of the capacitor 27 and/or the manner of how a short-circuiting has occurred. Therefore, in the above-described manner, the determination of whether it is the interruption time or the normal time is performable simply and securely.

However, the present disclosure is not limited to the above. That is, the interrupter wirings 28 and 29 may be positioned on the upstream side of the charge switch 25 or the capacitor 27. However, it is may be preferable to position the interrupter wirings 28 and 29 on the ground side of the charge switch 25 or the capacitor 27, as mentioned above.

In the ECU 100 of the present embodiment, a ceramic multilayer capacitor is used as the capacitor 27. The ceramic multilayer capacitor is a capacitor that is made by alternatingly layering a dielectric layer which consists of ceramic and a conductor layer. Thereby, although the ceramic multilayer capacitor has a smaller volume in comparison to the other electrolytic capacitors, the ceramic multilayer capacitor may be more prone to a short-circuiting. However, according to the ECU 100 of the present embodiment, since a control for preventing a delay of the fuel injection start timing is performed in the above-described manner when the capacitor 27 is short-circuited, the ECU 100 can have a smaller volume without having a delay of the fuel injection start timing at the short-circuit trouble time.

According to the ECU 100 of the present embodiment, the fusing temperature of the interrupter wirings 28 and 29 is set up so that the interrupter wirings 28 and 29 are fused before the temperature of the coil 24 exceeds a preset temperature by a self-generated heat that is caused by the electric current following therein. That is, in other words, since the interrupter wirings 28 and 29 are fused before the temperature of the coil 24 exceeds a preset temperature, which interrupts the electric current flowing in the coil 24 and stops a heat generation by such electric current, a burn-out of the coil 24 due to the excessive heat is prevented.

Other Embodiments

Although the present disclosure has been fully described in connection with preferred embodiment thereof with reference to the accompanying drawings, it is to be noted that various changes and modifications become apparent to those skilled in the art.

According to the first embodiment, it is provided that the fuel is directly injected to the combustion chamber 501. However, the injector 502 is not limited to such a configuration. That is, it may be provided that the fuel may be injected into an inlet pipe.

In the first embodiment, the interrupter wirings 28 and 29 are disposed in series to the charge switch 25 or the capacitor 27, respectively. However, the interrupter wiring may be provided for only one of the charge switch 25 and the capacitor 27. That is, only the charge switch 25 may have the interrupter wiring 28, or only the capacitor 27 may have the interrupter wiring 29.

In case that the interrupter wiring 28 is provided only for the charge switch 25, since interrupter wiring 28 is interrupted when the charge switch 25 is short-circuited, the first electric current path 21 is not short-circuited to the ground. Thereby, the booster circuit 20 is enabled to output a voltage that is higher than a short-circuiting time of the first electric current path 21 to the ground, i.e., a voltage that is substantially the same as the battery voltage VB.

The interception of the interrupter wiring 28 is detected by the monitor part 33, and, in response, the application of the voltage to the injector 502 is started at an earlier timing that is earlier relative to the normal time by the control of the microcomputer 30. Thereby, the delay of the fuel injection start timing due to a short-circuiting is prevented.

On the other hand, in case that the interrupter wiring 29 is provided only for the capacitor 27, since the interrupter wiring 29 is interrupted when the capacitor 27 is short-circuited, the first electric current path 21 is not short-circuited to the ground. Thereby, the booster circuit 20 is enabled to output a voltage that is higher than a first electric current path 21 short-circuiting time to the ground, i.e., a voltage that is substantially the same as the battery voltage VB.

The interception of the interrupter wiring 29 is detected by the monitor part 33, and, in response, the application of the voltage to the injector 502 is started at an earlier timing earlier than the normal time by the control of the microcomputer 30. Thereby, the delay of the fuel injection start timing due to short-circuiting is prevented.

Further, in the first embodiment described above, when the flag value is 0. i.e., when short-circuiting has not occurred, an example is shown in which the switch instruction part 32 in S112 of the flowcharted process sends an ON instruction to the constant electric current switch 11, the discharge switch 12, and the downstream switch 13. However, when the flag value is 0, i.e., when short-circuiting has not occurred, the switch instruction part 32 may, for example, send an ON instruction only to the discharge switch 12 and the downstream switch 13, without sending an ON instruction to the constant electric current switch 11. In such a case, the discharge switch 12 and the downstream switch 13 are turned ON, and the boosted voltage is applied to the magnet coil 502*a* of the injector 502, and the electric current flowing in the magnet coil 502*a* steeply increases.

Further, in the first embodiment described above, when the flag value is 1, i.e., when a short-circuit has occurred, an example is shown in which the switch instruction part 32 in S112 of the flowcharted process sends an ON instruction to the constant electric current switch 11 and the downstream switch 13. However, when the flag value is 1, i.e., when a short-circuit has occurred, the switch instruction part 32 may, for example, send an ON instruction also to the discharge switch 12 while sending an ON instruction to the constant electric current switch 11 and the downstream switch 13.

However, since the booster circuit 20 loses its booster function when the flag value is 1, i.e., when a short-circuit has occurred, the output voltage of the booster circuit 20 is the same as the battery voltage VB. Further, when the output voltage of the booster circuit 20 is used, electric current flows in the coil 24, which generates heat. Therefore, the ECU 100 in the first embodiment is configured to turn ON the constant electric current switch 11 and to turn OFF the discharge switch 12, for preventing the heat generation and for the application of the battery voltage VB, which is preferable.

Further, in the first embodiment, the fusing temperature of the interrupter wirings 28 and 29 is set to fuse them before the self-generated heat in the coil 24 exceeds a preset temperature. However, such configuration may be changed to a different setting. Even in such case, the fusing temperature of the interrupter wirings 28 and 29 is preferably set to fuse them before the self-generated heat in the coil 24 exceeds a preset temperature, for preventing an excessive temperature in the coil 24 which exceeds the preset temperature and burns out the coil 24 itself.

Although the configuration in the first embodiment opens the valve by supplying electric current to the magnet coil 502*a*, the valve may be opened by supplying electric current to a piezoelectric element, for example.

Such changes, modifications, and summarized schemes are to be understood as being within the scope of the present disclosure as defined by appended claims.

What is claimed is:

1. An electrical control unit for controlling an operation of a fuel injector, the electrical control unit comprising:

a constant voltage supply unit supplying a preset voltage to the fuel injector;

a boosted voltage supply unit supplying, to the fuel injector, a boosted voltage that is higher than the preset voltage; and a control unit controlling a supply timing of the constant voltage supply unit and a supply timing of the boosted voltage supply unit, wherein the boosted voltage supply unit includes a booster circuit having an input of a power supply voltage, generating the boosted voltage by boosting the power supply voltage, and outputting the boosted voltage, and a discharge unit electrically connecting the booster circuit and the fuel injector when turned ON, and electrically interrupting the booster circuit and the fuel injector when turned OFF, and the booster circuit includes a coil disposed in a first current path to which the power supply voltage is input on one end of the coil and from which the boosted voltage is output, a switching element (i) disposed in a second current path that leads from an other end of the coil to a reference voltage that is lower than the power supply voltage and (ii) supplying electric current to the coil when turned ON, a capacitor (i) disposed in a third current path that leads from a junction of the first current path and the second current path and leads to the reference voltage and (ii) charged by a counter electromotive force that is generated in the coil due to the turning ON and OFF of the switching element, and an interrupter (i) disposed in at least one of the second current path or the third current path, (ii) connected in series with the switching element or the capacitor, and (iii) interrupting electric current flowing through the interrupter when the switching element or the capacitor is short-circuited, and the control unit includes a detector detecting whether the interrupter is interrupted, wherein at a fuel injection start time of the fuel injector, the control unit controls the discharge unit and the constant voltage supply unit to (i) supply the boosted voltage to start the fuel injection, (ii) supply the preset voltage to continue the fuel injection when the detector detects that the interrupter is not interrupted, and (iii) advance an interrupted power supply start timing relative to a non-interrupted power supply start timing when the detector detects that the interrupter is interrupted.

2. The electrical control unit of claim 1, wherein when detected that the interrupter is interrupted, the control unit stops a voltage supply from the boosted voltage supply unit by turning OFF the discharge unit, and controls a voltage supply timing to the constant voltage supply unit to advance the interrupted power supply start timing relative to the non-interrupted power supply start timing.

3. The electrical control unit of claim 1, wherein the interrupter is disposed on a reference voltage side of the switching element or the capacitor, and the detector detects whether the interrupter is interrupted based on a voltage between (a) the interrupter and (b) the switching element or the capacitor.

4. The electrical control unit of claim 1, wherein the capacitor is a ceramic multilayer capacitor.

5. The electrical control unit of claim 1, wherein the interrupter is a fuse which is self-heated by electric current flowing therein and is fused when a self-heated temperature exceeds a preset fusing temperature, and the preset fusing temperature is set so that the interrupter is fused before a temperature of the coil exceeds a predetermined temperature due to a self-heating of the coil by the electric current flowing therein.

* * * * *